US006135670A

United States Patent [19]

Bahnman et al.

[11] Patent Number: 6,135,670

[45] Date of Patent: Oct. 24, 2000

[54] POLISHED ROD CLAMP

[76] Inventors: Reuben G. Bahnman, Box 88, Loreburn, Saskatchewan, Canada, S0H 2S0; Allen B. Larson, Box 261, Carnduff, Saskatchewan, Canada, S0C 0S0

[21] Appl. No.: 09/116,580

[22] Filed: Jul. 16, 1998

[51] Int. Cl.[7] ..... E21B 12/00

[52] U.S. Cl. ..... 403/373; 403/310; 166/77.51; 74/586

[58] Field of Search ..... 403/373, 312, 403/310, 309, 305, 302, 300, 301; 166/75.11, 77.51, 93.1, 96.1, 75.14, 105, 68.5, 242.5; 24/339, 269, 569, 568; 74/586

[56] References Cited

U.S. PATENT DOCUMENTS

| | | | |
|---|---|---|---|
| D. 310,471 | 9/1990 | Kuykendall . | |
| 1,417,490 | 5/1922 | Brandon | 166/77.51 X |
| 1,664,709 | 4/1928 | Severns et al. . | |
| 2,259,020 | 10/1941 | Wineman | 74/586 |
| 2,779,815 | 1/1957 | Sokol | 24/569 X |
| 3,251,310 | 5/1966 | Wittwer et al. | 74/586 |
| 3,475,798 | 11/1969 | Crickmer . | |
| 4,286,656 | 9/1981 | Felder | 74/586 X |
| 4,296,678 | 10/1981 | Felder . | |
| 4,498,845 | 2/1985 | Pittman et al. . | |
| 4,534,746 | 8/1985 | Hausinger | 464/182 X |
| 4,574,881 | 3/1986 | Bednarz | 166/75.11 X |
| 5,058,454 | 10/1991 | Head | 74/586 |
| 5,394,939 | 3/1995 | Walker | 166/93.1 X |
| 5,441,108 | 8/1995 | Jenkins et al. | 166/93.1 |

*Primary Examiner*—Lynne H. Browne
*Assistant Examiner*—John R. Cottingham
*Attorney, Agent, or Firm*—Murray E. Thrift; Adrian D. Battison; Michael R. Williams

[57] ABSTRACT

In an oil well pump, a rod liner is clamped onto a polished rod using an external clamp with an upper clamp section that clamps onto the polished rod, a lower clamp section that clamps onto the liner below the liner head and a yoke section bridging the upper and lower clamp section. In the preferred embodiment, the clamp has a main body extending across the liner head and upper and lower clamping blocks for clamping the rod and the liner respectively to the main body on opposite sides of the liner head.

9 Claims, 2 Drawing Sheets

FIG. 1
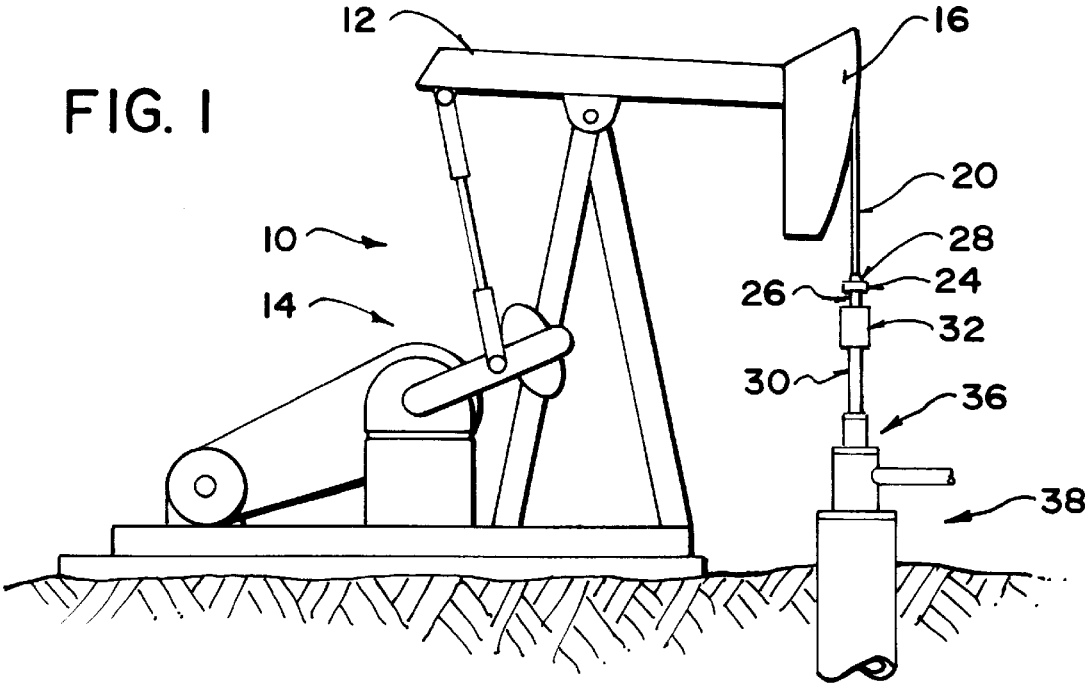
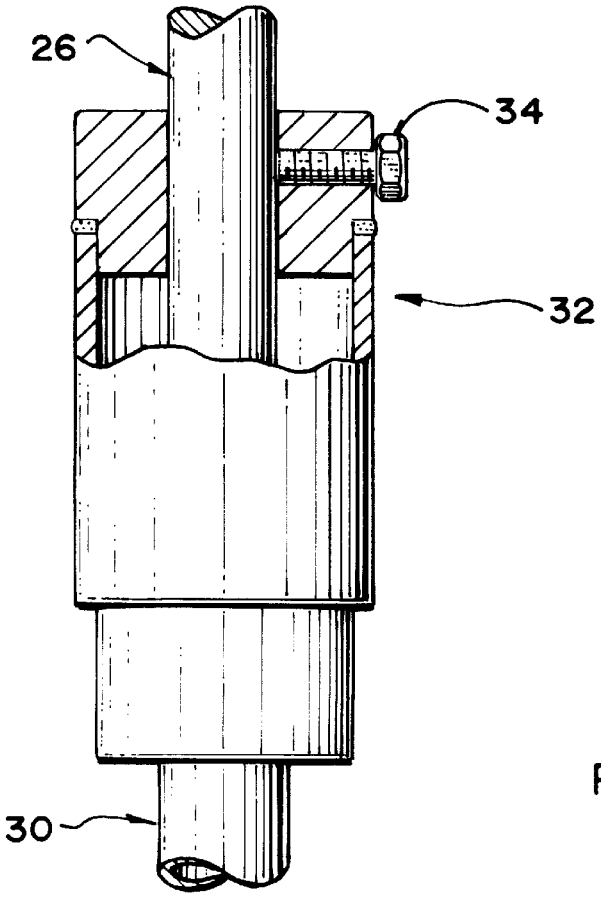
FIG. 2
PRIOR ART

POLISHED ROD CLAMP

FIELD OF THE INVENTION

The present invention relates to oil well pumps and more particularly to a rod type of pump and a rod liner clamp therefor.

BACKGROUND

In many rod type oil well pumps, the pump is driven by a reciprocating polished rod and the rod is surrounded by a rod liner. The liner has a liner head at its top end, which is fixed to the polished rod by bolts threaded into radial bores in the liner head and acting on the polished rod is set screws.

It is common for the connection between the liner and the polished rod to fail. When it does, oil may be pumped from the top of the liner producing an unacceptable spill. Various solutions have been proposed for capturing oil leaks of this sort or for closing valves included in the system to prevent the leakage.

Another problem that arises is repair of a pump in which the connection of the liner to the polished rod has failed. This may be a difficult and time-consuming task that may involve the disassembly of the liner from the polished rod. The resultant assembly is just as subject to failure as the original.

The present invention is concerned with an apparatus that may serve for the rapid repair of damaged pumps and the prevention of further failure. Where desired, it can be used as an original installation.

SUMMARY

According to the present invention there is provided in an oil well pumping unit including:

a polished rod;

a polished rod liner surrounding the polished rod;

a liner head secured to an upper end of the liner, the improvement comprising a liner clamp comprising:

a yoke bridging the liner head;

a lower clamp section clamped onto the liner adjacent the liner head; and an upper clamp section clamped onto the polished rod adjacent the liner head.

The clamp thus clamps onto the polished rod above the liner head and to the liner below the liner head, to hold the liner in place on the polished rod.

In preferred embodiments, the upper and lower clamp sections are respective sections of a main block extending across one side of the liner head and auxiliary upper and lower clamping blocks that extend across the opposite sides of the polished rod and the liner above and below the liner head. These auxiliary blocks are fastened to the main block to clamp the polished rod and the liner in place. Grooves in the blocks ensure that the contact surface between the clamps and the polished rod and liner have an area much larger than the clamping area of the prior art bolts and thus provide a more secure connection.

BRIEF DESCRIPTION OF THE DRAWINGS

In the accompanying drawings, which illustrate an exemplary embodiment of the present invention:

FIG. 1 is a side view of a pumping system according to the present invention;

FIG. 2 is a side view, partially in section of the prior art liner head clamping system;

DETAILED DESCRIPTION

Figure 3:
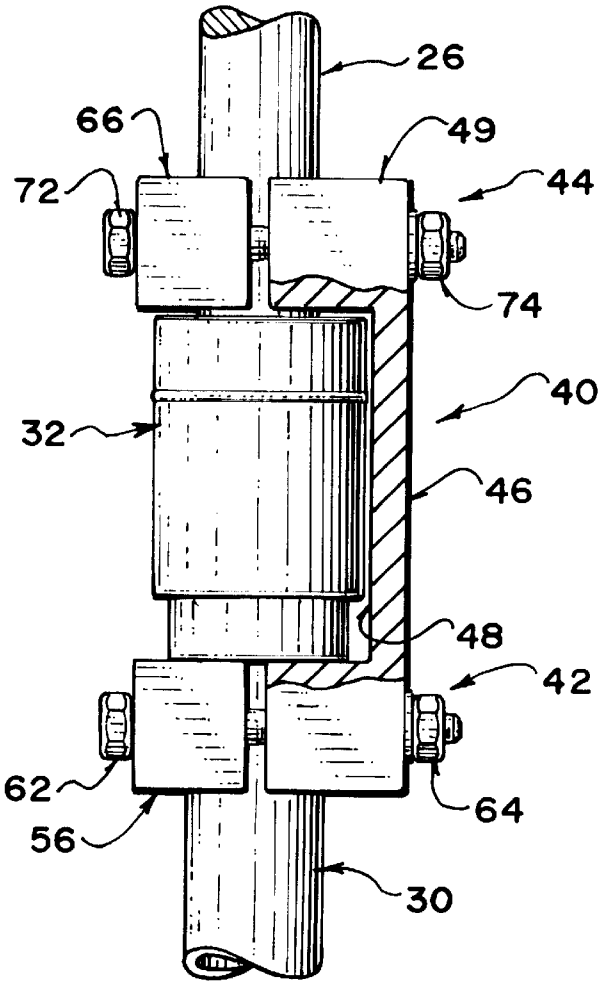
FIG. 3 is a side view, partly broken away, of a polished rod, liner and clamp assembly according to the present invention.

Referring to the accompanying drawings, and particularly to FIG. 1, there is illustrated a conventional oil well pump 10. The pump includes a walking beam 12 oscillated by a drive 14. The walking beam carries a head 16. Suspended from the head by two cables 20 is a hanger bar 24. A polished rod 26 is clamped to the hanger bar 24 by a polished rod clamp 28. Below the hanger bar 24, a liner 30 surrounds the polished rod 26. The liner has a head 32.

In the prior art arrangement illustrated in FIG. 2, the liner head 32 is secured to the polished rod by a set of radial bolts 34 threaded into the liner head and engaging against the surface of the polished rod. The liner and polished rod extend downwardly through a stuffing box 36 of a well head 38.

Figure 4:
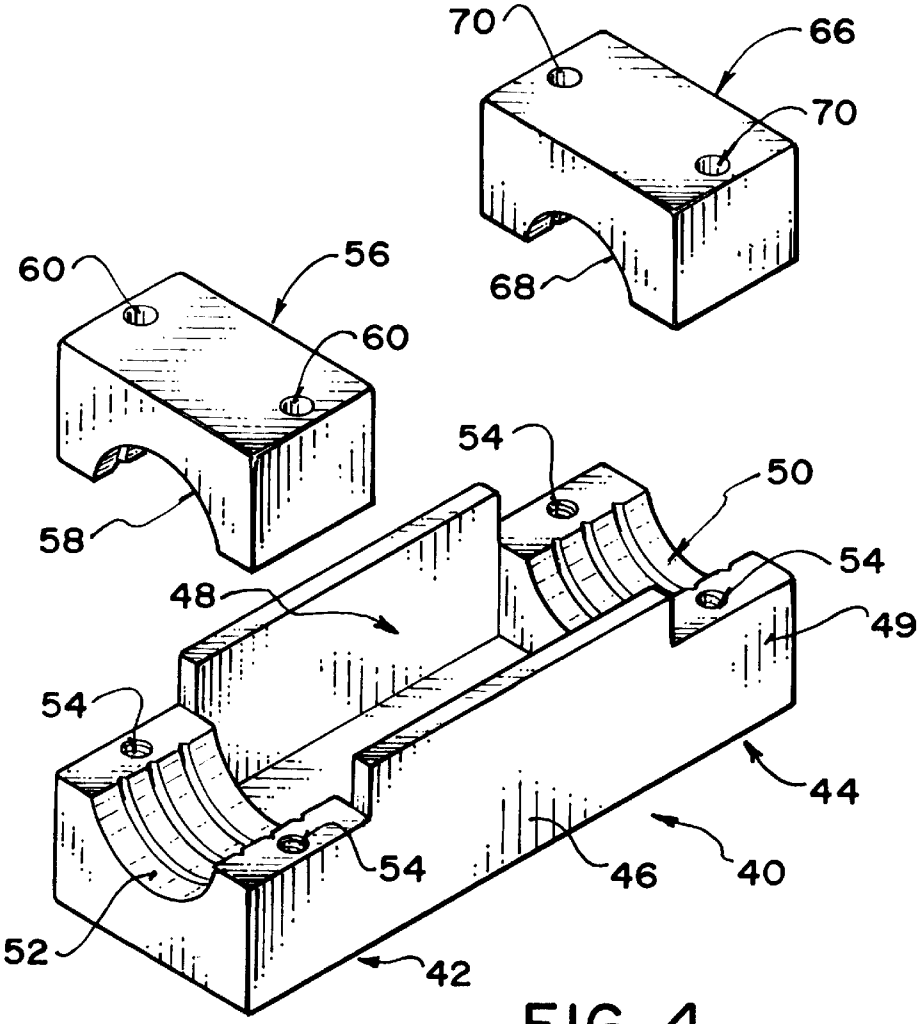
FIG. 4 is an exploded isometric view of a clamp according to the present invention.

With the present arrangement, as illustrated in FIGS. 3 and 4, the liner is fixed to the polished rod by a liner clamp 40. This includes a lower clamp section 42 that clamps onto the liner, an upper clamp 44 that clamps onto the polished rod and a yoke section joining the upper and lower clamps and bridging the liner head 32.

The liner clamp includes a main body 46 that includes the yoke section of the clamp. This section includes a central recess 48 configured to receive the liner head. Above the yoke section the main body has an upper clamping section 49 with a longitudinal groove 50. Below the yoke section is a lower clamping section with a longitudinal groove 52. The grooves 50 and 52 are part cylindrical in configuration, closely matching the shape of the polished rod and the liner respectively.

There are four bores 54 through the main body, two above the central yoke section and two below.

To secure the main body of the clamp to the liner, the clamp includes a lower clamping block 56 with a part cylindrical groove 58 and two bores 60 that align with the lower bores 54 in the main body to receive bolts 62 through the aligned bores. Nut 64 tightened on the bolts to clamp the liner between the grooves in the main body and the lower clamping block. Similarly, the upper clamp includes an upper clamping block 66 and a part cylindrical groove 68. Bores 70 on opposite sides of the upper clamping block align with the upper bores 54 in the main body to receive bolts 72. Nuts 74 on the bolts clamp the polished rod between the main body and the upper clamping block above the liner head.

The relatively large clamping surface of the upper and lower clamps ensures a strong connection between the clamp and the polished rod and the rod liner. This significantly reduces the frequency of failures in the coupling of the liner to the polished rod. When used for a repair, the clamp can be installed very quickly with a minimum of downtime.

While one embodiment of the present invention has been described in the foregoing, it is to be understood that other embodiments are possible within the scope of the invention and are intended to be included herein. The invention is to be considered limited solely by the scope of the appended claims.

What is claimed is:

1. In an oil well pumping unit including:

a polished rod;

a polished rod liner surrounding the polished rod;

a liner head secured to an upper end of the liner, the improvement comprising a liner clamp comprising:

a yoke bridging the liner head;

a lower clamp section clamped onto the liner adjacent the liner head; and an upper clamp section clamped onto the polished rod adjacent the liner head.

2. In an oil well pumping unit including:

a polished rod;

a polished rod liner surrounding the polished rod;

a liner head secured to an upper end of the liner, the improvement comprising a liner clamp comprising:

a main body extending across one side of the liner head;

a lower clamp section including a lower section of the main body, and a lower clamping block secured to the lower section of the main body, below the liner head, clamping the liner therebetween; and an upper clamp section clamped onto the polished rod adjacent the liner head.

3. An invention according to claim 2 including a recess in the main body between the upper and lower sections for receiving the liner head therein.

4. The invention according to claim 2 wherein the lower clamp section comprises confronting grooves in the lower clamp block and the lower section of the main body for engaging opposite sides of the liner.

5. The invention according to claim 3 wherein the upper clamp section comprises an upper section of the main block and an upper clamping block secured to the upper section of the main body of the liner head and clamping the polished rod therebetween.

6. The invention according to claim 5 wherein the upper clamp section comprises confronting grooves in the upper clamping block and the upper section of the main body for engaging opposite sides of the polished rod.

7. The invention according to claim 4 wherein the upper clamp section comprises an upper section of the main body and an upper clamping block secured to the upper section of the main block of the liner head and clamping the polished rod therebetween.

8. The invention according to claim 7 wherein the upper clamp section comprises confronting grooves in the upper clamping block and the upper section of the main body for engaging opposite sides of the polished rod.

9. In an oil well pumping unit including:

a polished rod liner;

a polished rod surrounded by the polished rod liner and projecting from an upper end of the polished rod liner;

a liner head secured to an upper end of the liner and surrounding the polished rod, with the polished rod projecting from the upper end of the liner head, the improvement comprising a liner clamp comprising:

a lower clamp section secured to the liner below the liner head;

an upper clamp section secured to the polished rod above the liner head; and a yoke bridging the liner head and secured to the upper and lower clamp sections thereby fixing the liner to the polished rod.

* * * * *